US005540352A

United States Patent [19]

Halasz et al.

[11] Patent Number: 5,540,352

[45] Date of Patent: Jul. 30, 1996

[54] METHOD AND APPARATUS FOR REFORMING CAN BOTTOM TO PROVIDE IMPROVED STRENGTH

[75] Inventors: Andrew Halasz, Crystal Lake; Sylvan Praturlon, Oak Park; Paul Azzaline, Crystal Lake; Christopher Caliendo, Wood Dale; Richard D. Zenger, Downers Grove, all of Ill.

[73] Assignee: American National Can Company, Chicago, Ill.

[21] Appl. No.: 185,839

[22] PCT Filed: Jul. 27, 1992

[86] PCT No.: PCT/US92/06198

§ 371 Date: Jul. 5, 1994

§ 102(e) Date: Jul. 5, 1994

[87] PCT Pub. No.: WO93/01903

PCT Pub. Date: Feb. 4, 1993

Related U.S. Application Data

[63] Continuation-in-part of Ser. No. 735,994, Jul. 25, 1991, Pat. No. 5,222,385, which is a continuation-in-part of Ser. No. 730,794, Jul. 24, 1991, Pat. No. 5,349,837.

[51] Int. Cl.[6] ..... B21D 51/26

[52] U.S. Cl. ..... 220/606; 220/608; 72/379.4

[58] Field of Search ..... 72/94, 105, 106, 72/110, 111, 117, 379.4; 220/606, 906, 608

[56] References Cited

U.S. PATENT DOCUMENTS

| | | |
|---|---|---|
| 994,468 | 6/1911 | Kane . |
| 1,031,264 | 7/1912 | Hinde et al. . |
| 1,441,674 | 1/1923 | Foster et al. . |
| 1,461,729 | 7/1923 | Foster et al. . |
| 3,417,898 | 12/1968 | Bosek et al. . |
| 3,693,828 | 9/1972 | Kneusel . |
| 3,904,069 | 9/1975 | Toukmanian . |
| 3,905,507 | 9/1975 | Lyu . |
| 3,942,673 | 3/1976 | Lyu et al. . |
| 4,108,324 | 8/1978 | Krishnakumar et al. . |
| 4,120,419 | 10/1978 | Saunders . |
| 4,134,354 | 1/1979 | Cvacho et al. . |
| 4,147,271 | 4/1979 | Yamaguchi . |
| 4,151,927 | 5/1979 | Cvacho et al. . |
| 4,199,073 | 4/1980 | Gombas . |
| 4,280,353 | 7/1981 | Murphy . |
| 4,289,014 | 9/1981 | Maeder et al. . |
| 4,294,097 | 10/1981 | Gombas . |
| 4,294,373 | 10/1981 | Miller et al. . |
| 4,341,321 | 7/1982 | Gombas . |
| 4,372,143 | 2/1983 | Elert et al. . |
| 4,381,061 | 4/1983 | Cerny et al. . |
| 4,402,419 | 9/1983 | MacPherson . |
| 4,412,627 | 11/1983 | Houghton et al. . |
| 4,419,319 | 12/1983 | Reynolds, Jr. et al. . |
| 4,454,742 | 6/1984 | Gombas . |
| 4,470,281 | 9/1984 | Kaporovich et al. . |
| 4,515,284 | 5/1985 | Lee, Jr. et al. . |
| 4,598,831 | 7/1986 | Nakamura et al. . |
| 4,620,434 | 11/1986 | Pulciano et al. . |

(List continued on next page.)

FOREIGN PATENT DOCUMENTS

| | | |
|---|---|---|
| 8102754 U | 2/1981 | Germany . |
| 2094276 | 2/1982 | United Kingdom . |

*Primary Examiner*—Lowell A. Larson
*Attorney, Agent, or Firm*—Wallenstein & Wagner, Ltd.

[57] ABSTRACT

A method and apparatus for reforming the bottom of a container (20) and a container made by that method is disclosed. The container for which this method and apparatus are suitable has an outer annular wall (26); a convex U-shaped portion (28); a preformed bottom wall (30), including a center domed portion (32); and an annular wall (34) joining the domed portion and the convex U-shaped portion. The method comprises supporting the bottom peripheral profile portion and bringing a reforming means (36) into engagement with the annular wall. The reforming means is brought to bear against the annular wall to rework the annular wall. The reforming means can also reform the outer annular wall.

11 Claims, 10 Drawing Sheets

U.S. PATENT DOCUMENTS 4,650,628 3/1987 Evely .
4,685,582 8/1987 Pulciani et al. .
4,717,523 1/1988 Evely .
4,732,292 3/1988 Supik .
4,768,672 9/1988 Pulciani et al. .
4,834,256 5/1989 McMillin .
4,885,924 12/1989 Claydon et al. .
4,919,294 4/1990 Kawamoto et al. .
4,953,738 9/1990 Stirbis .
5,069,052 12/1991 Porucznik et al. ..... 72/84
5,105,973 4/1991 Jentzsch et al. .
5,111,679 5/1992 Kobayashi et al. .
5,222,385 6/1993 Halasz et al. ..... 72/117
5,341,667 8/1994 Lee, Jr. ..... 72/379.4
5,351,852 10/1994 Trageser et al. ..... 220/606

METHOD AND APPARATUS FOR REFORMING CAN BOTTOM TO PROVIDE IMPROVED STRENGTH

RELATED APPLICATIONS

This is a continuation-in-part of U.S. application Ser. No. 07/735,994, filed on Jul. 25, 1991, now U.S. Pat. No. 5,222,785, which is in turn a continuation-in part of U.S. application Ser. No. 07/730,794, filed on Jul. 24, 1991, now U.S. Pat. No. 5,349,837, which is in turn based upon and claims priority from International Application No. PCT/US90/00451, having an International filing date of Jan. 26, 1990.

DESCRIPTION

1. Technical Field

The invention relates generally to a method and apparatus for forming an improved, reformed can bottom, with a result that the entire can is strengthened. Typically, this method and apparatus are used for reforming the bottoms of drawn and ironed beverage containers. The reformed can bottom is an integral part of beer and beverage cans, and increases the strength of those cans above that of prior art cans.

2. Background of the Invention

Metal containers, and drawn or drawn and ironed metal containers in particular, are among the most widely used containers for pressurized carbonated beverages, including such beverages as beer and soft drinks. Such containers are also becoming increasingly popular for food and other uses.

Drawn and ironed metal containers are made from a disc of stock material which is converted into a shallow "cup" with short side walls. The base of this cup ultimately forms the bottom of the container, and the short side walls of the cup become the elongated side walls of the container.

The shallow cup is passed through a succession of ironing rings. As the spacing between successive rings becomes increasingly narrow, passage of the cup through these successive rings decreases the sidewall thickness and increases the height of the side walls.

The configuration of the bottom of such drawn and ironed containers has, over the last several years, been a topic of interest to both can manufacturers, packagers, shippers, retailers and the ultimate consumer who purchases products in such containers. This is because the configuration of the bottom is a factor in the ability of the container to resist its internal pressures and achieve adequate columnar strength, in addition to adding stability to the can. These internal pressures result from the weight, pressurization and carbonation of the liquids in the container. Columnar strength is the ability of a container to resist axial loads imposed by cans that are stacked upon other cans, as during transport and storage.

Can manufacturers are constantly striving to obtain high strength with relatively low weight. Generally, however, these goals are incompatible. Low weight, and a lowering of material cost, is generally achieved by reducing the thickness of the stock material. A reduction in stock material thickness, without more, typically lowers the strength of the container. Retailers and consumers desire a container which is stackable and which is of the lowest possible weight for ease in handling.

The bottom shape of the container has been found to be of importance in determining its strength. Issued U.S. patents disclosing this importance include U.S. Pat. No. 4,685,582, issued to Pulciani, et. al., on Aug. 11, 1987, and entitled "Container Profile With Stacking Feature." This patent, which is assigned to the assignee of the present invention, discloses a container having an inverted dome-shaped bottom. Other U.S. patents are also generally relevant. For example, U.S. Pat. Nos. 3,904,069, 3,979,009 and 4,412,627, disclose containers having bottom wall constructions designed to permit selected and controlled outward flexing or bulging of the bottom wall when the container is sealed and subjected to internal pressures developed by the contents.

Reforming of the bottom wall of a container of the general type described in this application has also been described in an Claydon, et. al., U.S. Pat. No. 4,885,924. This reforming takes place by applying a roller along the exterior transition wall 7 of the bottom of the container, rather than along its interior. However, when reforming the interior bottom wall to a negative angle, as shown in FIG. 10, a dedicated knock-out pad 46 is required. Additionally, due to material spring-back, it is more difficult to control the ultimate angle of the interior bottom wall.

Jentzsch, et. al., U.S. Pat. No. 5,105,973, issued Apr. 21, 1992, discloses a beverage container having an interior bottom wall with a negative angle. However, there is no disclosure of how this negative angle is formed.

The present invention is provided to solve these and other problems.

SUMMARY OF THE INVENTION

The invention is a method of and apparatus for reforming the bottom of a metal container as, for example, a drawn and ironed or a drawn beverage container, and the container formed by this method and apparatus. The container for which this method is suitable may have a longitudinal axis, typically a vertical axis, a generally cylindrical side wall parallel with the vertical axis, an outer annular wall, a convex U-shaped portion, a preformed bottom wall including a center domed portion, and an annular, substantially vertical wall joining the domed portion and the convex U-shaped portion. One aspect of the method comprises supporting the container in a jig. The jig has a bottom peripheral profile portion substantially corresponding in shape to the outer annular wall of the container. The bottom peripheral profile portion of the jig is then mated with the outer annular wall. A reforming means, such as a reforming roller is brought into engagement with the substantially vertical wall. The reforming roller rotates along the vertical wall and about an arcuate path, affecting the angle of the substantially vertical wall. The reforming roller farther reduces the radius of curvature of the inner curved portion of the convex U-shaped portion.

According to one aspect of the invention, the reforming means or roller affects the angle of the substantially vertical wall, achieving a negative angle from the vertical axis of the container.

According to another aspect of the invention, the reforming means or roller is rotated about an arcuate path equidistant from an axis that is coaxial with the vertical axis of the container.

According to yet another aspect of the invention, the reforming means or roller has a peripheral configuration which, upon engagement with the substantially vertical wall, reforms the substantially vertical wall to achieve the desired negative angle from the vertical axis of the container.

In another aspect of the invention, an actuator moves upwardly and towards the can to cause radial, outward movement of a camming surface. In this way, a roller that moves as a result of the movement of this camming surface is caused to engage a substantially vertical wall. This roller may pivot, about a horizontal pivot point, from an inward non-engaging position to a radially outward position where the roller engages the substantially vertical wall.

In a further aspect of the invention, an annular recess is formed in the radially outward portion of the convex U-shaped portion, as by a roller, to further increase the container's resistance to pressure.

This application is also directed to an apparatus which can be used to practice the method of the invention, and the container formed by the method and apparatus of the invention. The apparatus reforms the bottom wall of a container, and comprises means for supporting the container for reforming and a reforming tool for pressure engagement with the bottom wall to reform that bottom wall.

DETAILED DESCRIPTION OF THE PREFERRED EMBODIMENT

This invention is susceptible of embodiment in many different forms. The drawings and specification show a preferred embodiment of the invention. It will be understood, however, that this disclosure is to be considered an exemplification of the principles of the invention. The inventors do not intend to limit the broadest aspect of the invention to the illustrated embodiments.

Figure 8:
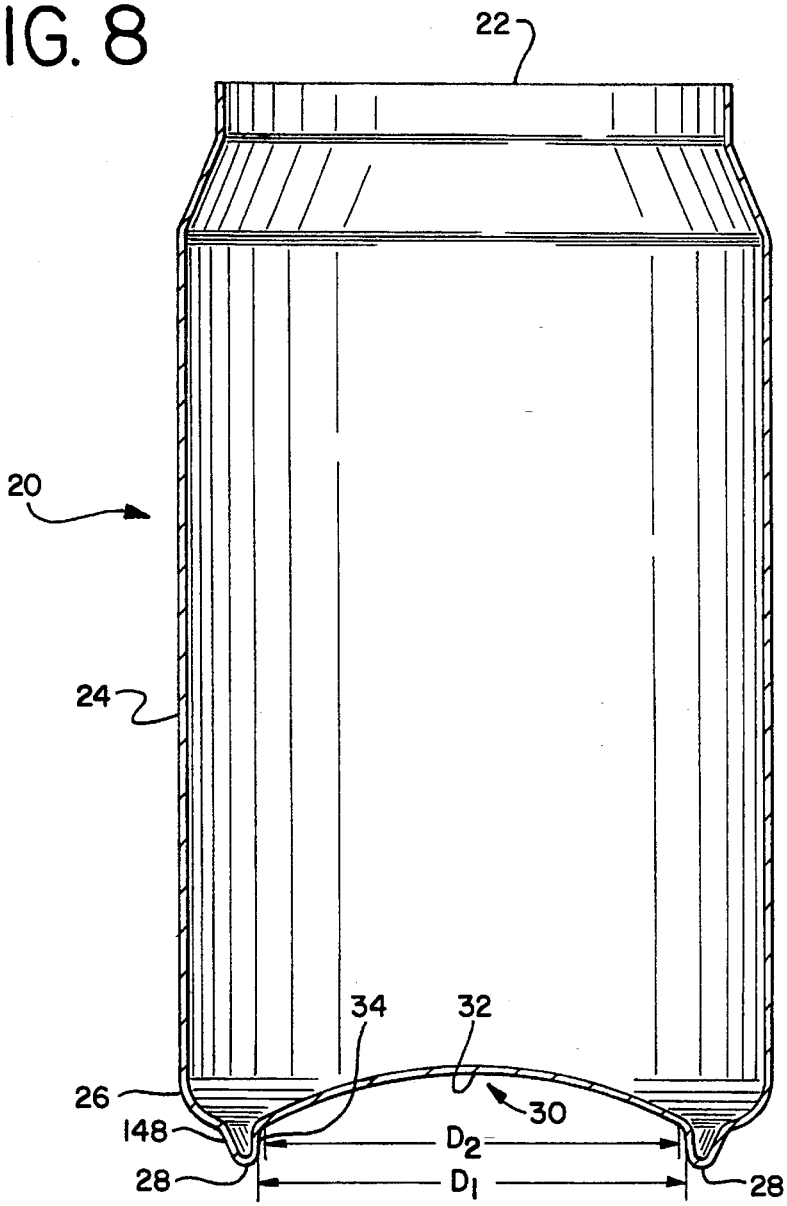
FIG. 8 is a side perspective view of a container which is suitable for treatment by the process and apparatus of the invention.

According to one aspect of the invention, the performance characteristics of a container, such as formed by normal drawing and ironing procedures, are improved by reforming the bottom end wall of the container from the initial configuration. This initial configuration is disclosed in the above-mentioned '582 patent and is shown in FIG. 8.

Figure 9:
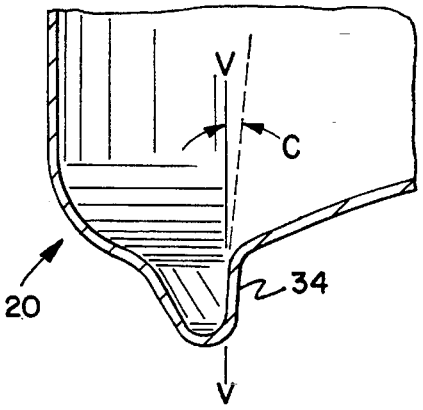
FIG. 9 is an enlarged view of the lower left hand corner of the container of FIG. 8, prior to reforming.
Figure 10:
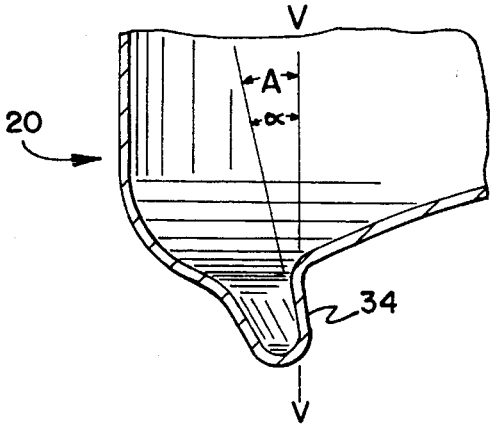
FIG. 10 is an enlarged view of the lower left hand corner of the container of FIG. 8, after reforming.

As described and shown in FIGS. 9 and 10 of co-pending International Application No. PCT/US90/00451, after the fluted container has been necked, flanged, internally spray coated and externally printed, the bottom profile or countersink area of the bottom wall is reshaped. This is done by reforming the inner wall of the countersink to further improve buckle resistance and decrease can growth.

Figure 11:
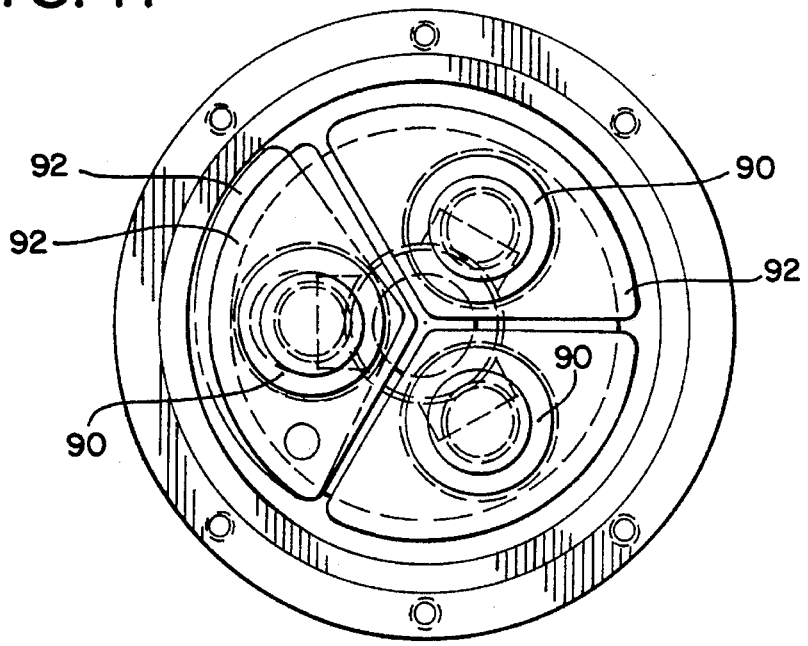
FIG. 11 is a top view of a non-pivoting embodiment of the apparatus in accordance with the invention.

In the prior co-pending application, the finished drawn and ironed container of FIG. 11 is supported in a suitable jig that has an internal opening which corresponds to the outer peripheral diameter of the container. The jig has a lower profile portion that conforms to the countersink wall portion at the bottom wall of the container.

A plug is inserted into the upper end of the opening and securely held in the top of the container. During processing, this container is rotated about its axis. The bottom peripheral profile of the jig is in extended contact with the container bottom. A reforming roller is brought into engagement with the substantially vertical wall of the domed end of the container and is supported on a shaft. That shaft is designed to be rotated along an arcuate path around the center axis for the container. The roller has a peripheral configuration which defines a substantially vertical upwardly and outwardly tapered wall having a generally arcuate upper portion. The inner wall of the countersink is reformed to a more vertical profile while the dome is stretched to a small degree. The outer wall is held to its original configuration. Alternatively, the outer wall could also be reformed with the inner wall, as will be explained below.

It was found in the co-pending application that this reforming operation significantly improves buckle resistance and decreases the amount of can growth, i.e., the amount that the bottom end wall is elongated when pressure is applied internally of the container.

The container produced according to the method and apparatus described in the co-pending application exhibited significantly greater column strength, i.e., resistance to crushing by vertical loads applied to the container side wall. That container also exhibited significantly less container growth during internal pressurization and improved buckle resistance. The container constructed in accordance with that invention was thus capable of being produced from stock flat disc material having a significantly reduced thickness.

The present invention is a further elaboration and refinement upon the invention described in the co-pending application. The invention is directed to a container 20, such as a drawn or drawn and ironed container shown in FIG. 8. Such containers are well known in the art and are generally described and shown in U.S. Pat. No. 4,685,582, issued to the assignee of the present application on Aug. 11, 1987. This container 20 is symmetrical about a vertical axis 22. A generally cylindrical side wall 24 parallel with this vertical axis forms the panel on which graphics, such as a bottler's trademark, may be printed. An outer annular wall 26 forms a transitional portion between this side wall 24 and a convex, U-shaped portion 28 that defines a flange-like ridge. The outer annular wall 26 and U-shaped portion 28 enable these cans to be stacked. In particular, the bottom of a first can may be securely nested into the top of a second can.

The container 20 also includes a preformed bottom wall 30 including a center domed portion 32. An annular, substantially vertical wall 34 joins the domed portion 32 to the convex U-shaped portion 28. This "substantially vertical wall," for the purposes of this application, has an angle from the vertical of 0 to +5 degrees, and may be as high as +10 degrees. A positive angle is shown by angle C in FIG. 9.

Various kinds of apparatus may be used to effect the method of reforming the container 20, as that method is described and claimed in the present application. As may be seen in FIGS. 1–3, one such apparatus includes a plurality of rollers 36. In a preferred embodiment, three rollers 36 may be used. The use of three rollers 36 has advantages over the use of fewer rollers, for example, a single roller. These rollers 36 are used to contact the annular, substantially vertical wall 34. The use of one roller would concentrate the force transferred from the roller 36 to the wall 34 in a single direction. In contrast, three rollers 36 will spread the force on this wall 34 over three points, thus imposing a net force of zero on the can. A greater number of rollers also results in a faster cycle for reforming. In the case of three rotating rollers vs. one rotating roller, and assuming that the rollers are being rotated about the can bottom at the same circumferential speed, the three-roller apparatus should accomplish its task in approximately one-third of the time necessary for the one-roller apparatus.

Figure 2:
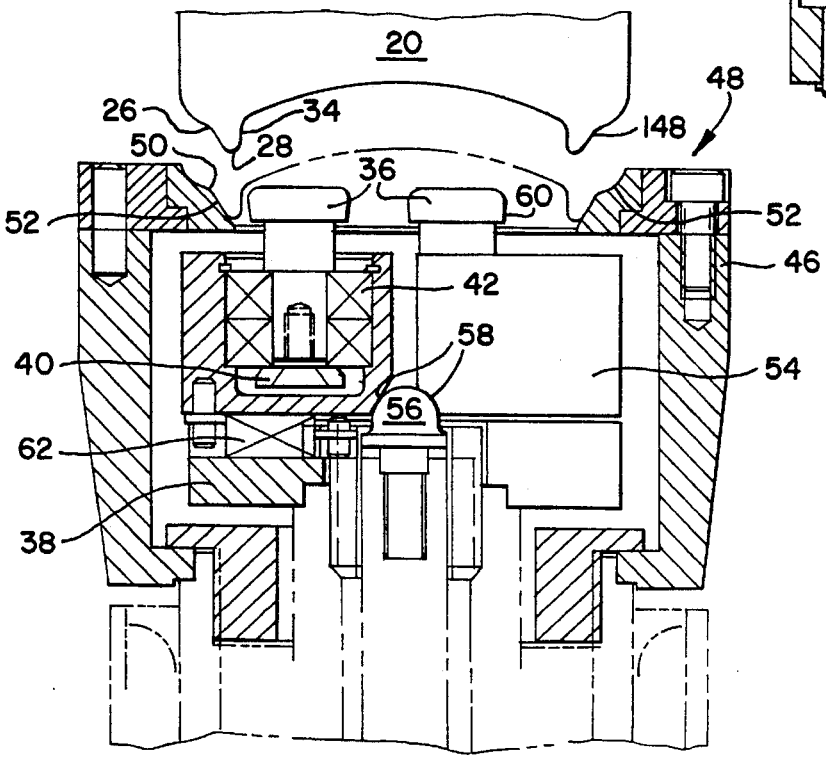
FIG. 2 is a side-sectional view of the apparatus of FIG. 1, and with a container shown in solid lines above the apparatus and in phantom lines in place for processing by the apparatus.

As may be seen in FIG. 2, each of these rollers 36 is indirectly secured to a pivot plate 38. Securing the rollers 36 are a bearing clamp 40 and a bearing 42.

Figure 1:
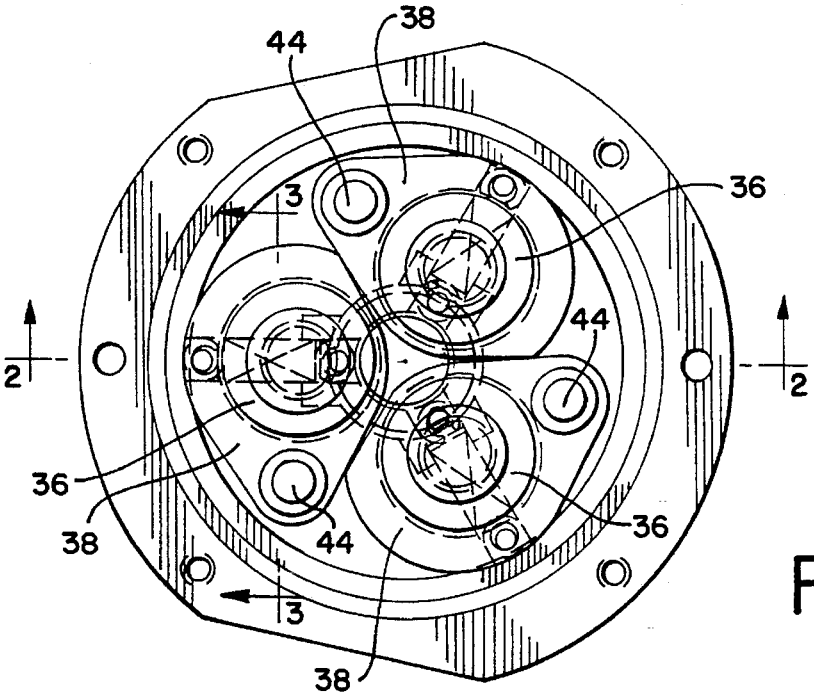
FIG. 1 is a top view of a pivoting apparatus for reforming a can bottom in accordance with the invention, and in a radially inward, non-engaging position.

Each of the pivot plates 38 are designed to pivot around their respective pivot pin 44 (FIG. 1). In this embodiment, this pivot pin 44 is vertically disposed. As will be seen in other embodiments, however, other pivot pins may instead be horizontally disposed.

A tooling head collar 46 provides a support surface for a jig 48, or lower can support. This jig 48 is removable from the tooling head collar 46 and may be interchanged with another jig having a different shape to accommodate containers having various different lower end configurations. The jig provides radially inward support to counter the outward force of the rollers.

Each jig 48 is manufactured to accommodate and support a given size container 20. Accordingly, a bottom peripheral profile portion 50 of the jig 48 substantially corresponds in shape to the outer annular wall 26 of the container 20. As will be explained below, this bottom peripheral profile portion 50 of the jig 48 is mated with the outer annular wall 26 of the container 20. In the embodiment shown in FIG. 2, it may be seen that the lowermost part 52 of this jig 48 also corresponds in shape to the radially outermost region of the convex U-shaped portion 28. In this way, the jig 48 provides greater support around the circumference of the container 20.

Supporting the bearings 42 and enclosing portions of the reforming rollers 36 are bearing housings 54. These bearing housings 54 are fixedly secured to their respective pivot plates 38. Thus, the motion of the pivot plates 38 and the bearing housings 54 is synchronous.

Movement of the pivot plates 38 and bearing housings 54 is facilitated by a vertically movable actuator ball 56. As shown in FIG. 2, this actuator ball 56 is positioned in a first, non-engaging position. In this position, the actuator ball 56 merely abuts against camming surfaces 58 on the bearing housing 54.

Upward, vertical movement urges the actuator ball 56 to a second position in which it contacts and pushes upwardly on camming surfaces 58. As a result of the shape of these camming surfaces 58, this upward movement causes the bearing housing 54 and pivot plate 38 to pivot together about the pivot pin 44 in a radially outward direction. This pivoting movement continues until rollers 36 contact the annular, substantially vertical wall 34.

The rollers 36, upon contact with this wall 34, rotate rapidly to force the wall from its configuration as shown in FIG. 9 to that shown in FIG. 10. Particularly, FIGS. 9 and 10 depict a vertical line V—V. Vertical line V—V is coincident with the vertical axis of container 20. FIG. 9 shows a container 20 before reforming. In this FIG. 9, the wall is substantially vertical and may even have a so-called "positive" angle. With reference to FIG. 9, a positive angle is one in which wall 34 angles upwardly and to the right of line V—V. An example of a positive angle appears as angle C in FIG. 9.

After contact by rollers 36, as described above, this wall 34 is reformed and may achieve a negative angle A. Additionally, the radius of curvature R is reduced. The results of reforming are shown, for example, in FIG. 10. As a result of this negative angle and reduced radius, as will be described below, container 20 has enhanced physical characteristics.

One advantage of the apparatus as shown in the present embodiments is that it is adaptable for containers having various bottom sizes. In many instances, one three-roller mechanism will be useful for reworking the inner walls of several different sizes of cans. To the extent that a roller mechanism may not be useful for a particular size can, an advantage of the present apparatus is that one need only change its rollers to enable the apparatus to rework the inner wall of the container.

Figure 3:
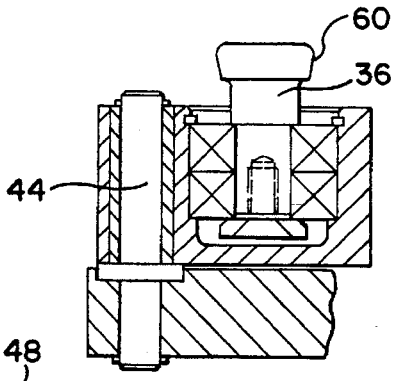
FIG. 3 is a detail of a portion of the apparatus of FIG. 2, showing the pivot pin about which the roller pivots.

In the apparatus of FIGS. 1–3, the pivot pin is substantially vertically disposed. As a result, the pivoting of the bearing housing 54 and the pivot plate 38 occur in a horizontal plane. Other embodiments, as described below, will include horizontal pivot pins, causing pivoting of the bearing housing and pivot plate in a vertical plane.

As may be seen in greatest detail in FIGS. 2 and 3, the reforming rollers 36 have a perimeter portion 60 that is downwardly tapered. It is this downwardly tapered configuration 60 which, when rollers 36 are placed against the substantially vertical wall 34, results in the reformation of that substantially vertical wall 34 to a wall having a negative angle.

Figure 1A:
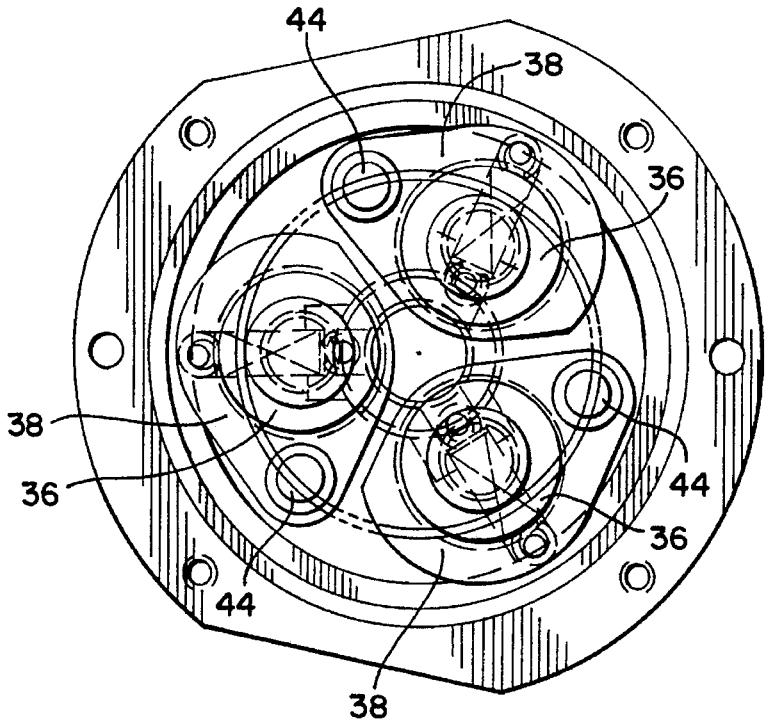
FIG. 1A is a view of the apparatus of FIG. 1, but with the rollers in a radially outward position and engaging the wall of a container.

After the completion of the reforming, the rollers 36 are retracted from the wall 34 and return from the position shown in FIG. 1A to the original position shown in FIG. 2. Each pivot plate 38 and bearing housing 54 assembly returns to this original position as a result of pressure from a compression spring 62.

Figure 4:
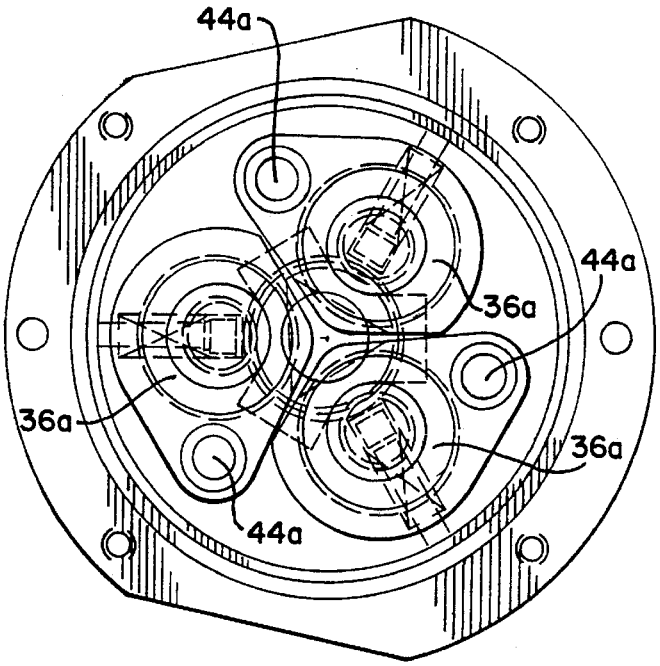
FIG. 4 is a top view of a second pivoting embodiment of the apparatus in accordance with the invention.
Figure 5:
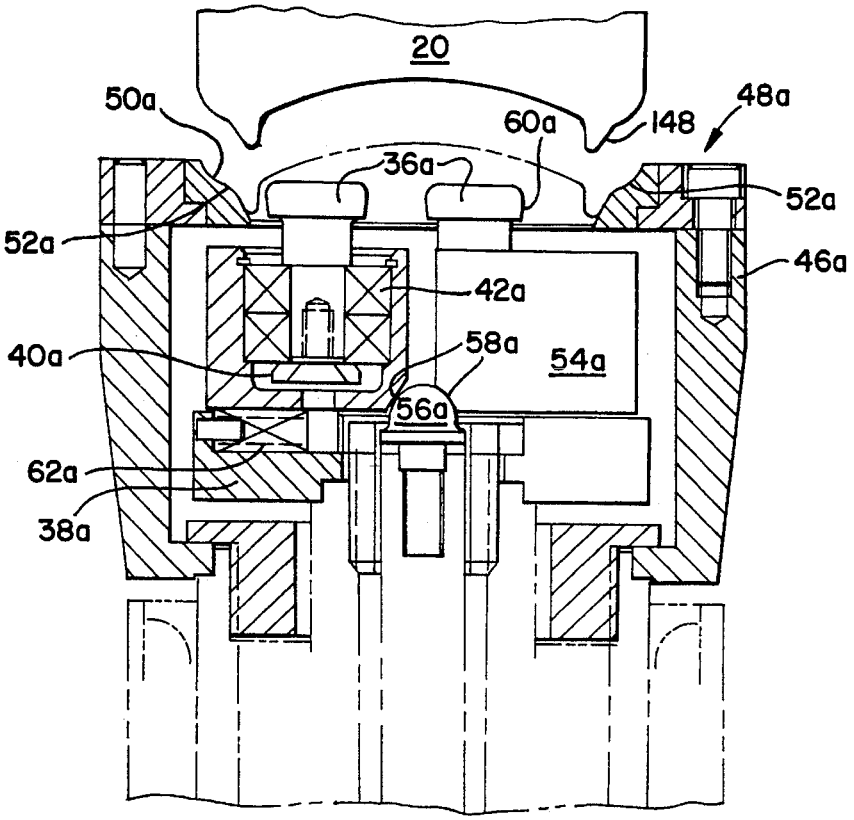
FIG. 5 is a side-sectional view of the apparatus of FIG. 4, and with a container shown in solid lines above the apparatus and in phantom lines in place for processing by the apparatus.

A slight modification of the reforming apparatus described above is shown in FIGS. 4 and 5. Each of the components of the embodiments of FIGS. 1–3 are correspondingly numbered in FIGS. 4 and 5, except that the reference numerals for the corresponding components in the latter figures include the suffix "a." The only component which differs significantly is the spring. Spring 62 of FIGS. 1–3 is an extension spring, whereas spring 62*a* of FIGS. 4–5 is a compression spring. As a result, the apparatus of FIGS. 4–5 works in a slightly different manner than the apparatus of FIGS. 1–3. Particularly, in FIGS. 1–3, upon completion of reforming, the rollers 36 are retracted from the wall 34 and returned to their original position as a result of both applied pressure from an extension spring 62 and retraction of the actuator ball 56. In FIGS. 4–5, upon completion of the reforming, the rollers 36*a* are retracted from the wall 34 and returned to their original position as a result of both applied pressure from a compression spring 62*a* and retraction of actuator ball 56*a*.

Figure 6:
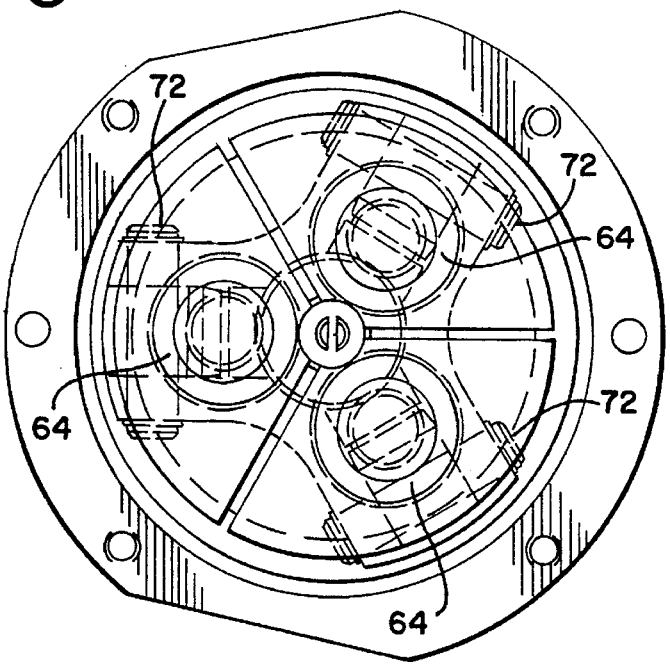
FIG. 6 is a top view of a third pivoting embodiment of the apparatus in accordance with the invention.
Figure 7:
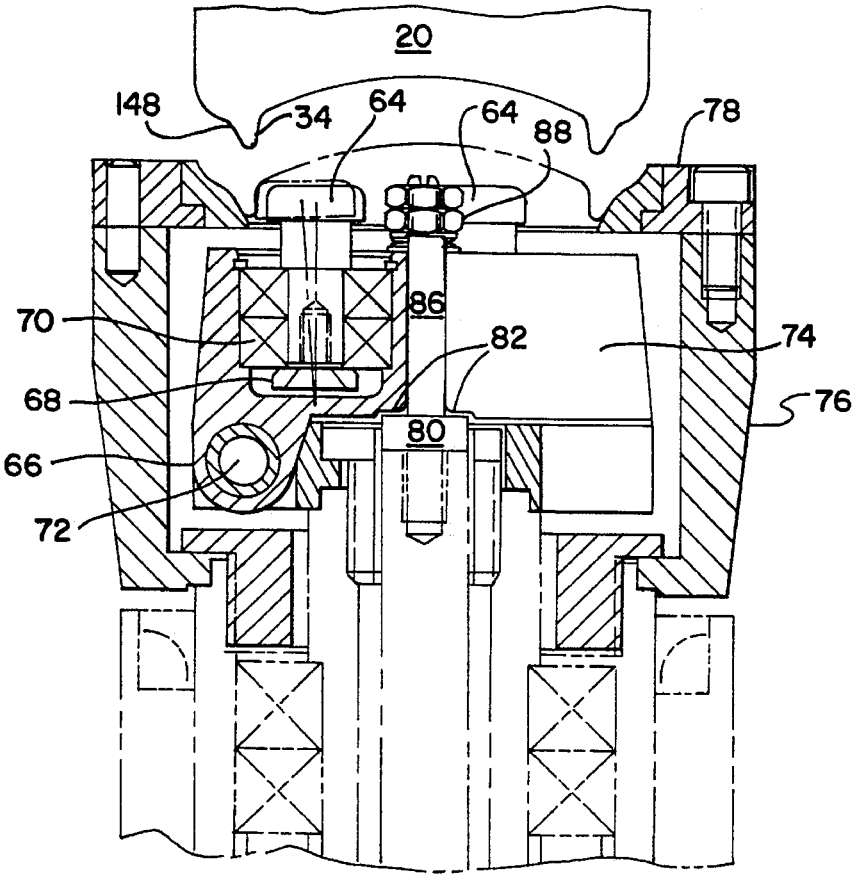
FIG. 7 is a side-sectional view of the apparatus of FIG. 6, and with a container shown in solid lines above the apparatus and in phantom lines in place for processing by the apparatus.

Still another embodiment is shown in FIGS. 6 and 7. This embodiment also includes three rollers 64. As may be seen in FIG. 7, each of these rollers 64 is indirectly secured to a pivot plate 66. Securing the rollers 64 are a bearing clamp 68 and at least one bearing 70.

Each of the pivot plates 66 are designed to pivot around their respective pivot pin 72. As may be seen in FIG. 7, this pivot pin 72 is horizontally disposed. As a result, the pivoting of the bearing housing 74 and the pivot plate 66 occur in a vertical plane.

As in the embodiment of FIGS. 1–3, the embodiment includes a tooling head collar 76 to provide a support surface for a jig 78, or lower can support. This jig 78 is also removable from the tooling head collar 76 and may be interchanged with another jig having a different shape to accommodate containers having various different lower end configurations.

Movement of the pivot plates 66 and bearing housings 74 is facilitated by a vertically movable actuator 80. As shown in FIG. 7, this actuator 80 is positioned in a first, non-engaging position. In this position, the actuator 80 merely abuts against camming surfaces 82 on the bearing housing 74.

Upward, vertical movement urges the actuator 80 to a second position in which it contacts and pushes upwardly on camming surfaces 82. As a result, this upward movement causes the bearing housing 74 and pivot plate 66 to pivot together about the pivot pin 72 in a vertical plane and a radially outward direction. This pivoting movement continues until rollers 64 contact the annular, substantially vertical wall 34 of container 20.

After the completion of the reforming, the rollers 64 are retracted from the wall 34 and return from the position shown in the dotted lines of FIG. 7 to the original position shown the solid lines of FIG. 7. Each pivot plate 66 and bearing housing 74 assembly returns to this original position as a result of pressure from a coil spring 84. This coil spring 84 encircles and is held upon a retaining post 86. The coil spring 84 is tensioned by compressing it between the top, abutting surfaces of bearing housings 74 and hex nut 88 secured to retaining post 86.

Still other embodiments of the present apparatus are depicted at FIGS. 11–19. As will be seen, the apparatus of these embodiments does not include a pivot pin for moving the rollers into engagement with the vertical wall 34 of the container 20. In many other respects, however, these apparatuses are similar to those shown in FIGS. 1–7.

Figure 12:
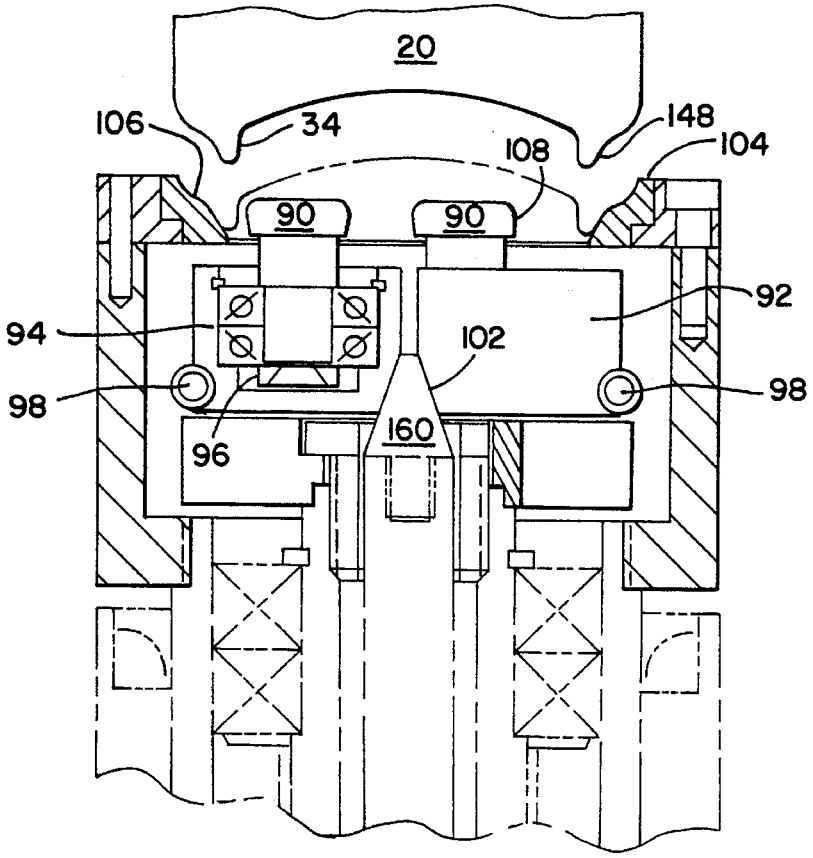
FIG. 12 is a side-sectional view of the apparatus of FIG. 11, and with a container shown in solid lines above the apparatus and in phantom lines in place for processing by the apparatus.

For example, the apparatus of FIG. 11 includes three rollers 90 secured to a bearing housing 92 with a bearing 94 and a bearing clamp 96. The solid lines of FIG. 12 show these rollers in a radially inward position, where the rollers 90 do not contact the annular, substantially vertical wall 34. These rollers 90 are movable from this position to a radially outward position where the roller contacts the annular, substantially vertical wall 34.

Bearing housings 92 are spring-biased. In particular, a tensioned garter spring 98 (FIG. 12) encircles the lower periphery of bearing housings 92. In their first, non-engaging position, as shown in the dotted lines of FIG. 11, the housings 92 and their related rollers 90 are retained by the garter spring 98 in a radially inward position.

The second position of the bearing housings 92 is shown in the solid lines of FIG. 11. The housings 92 attain this position when actuator 100 is moved upwardly against camming surfaces 102 of housing 92. This upward movement of actuator 100 pushes housings 92 radially outwardly until rollers 90 contact the annular, substantially vertical wall 34. Upon completion of treatment of the wall 34 with rollers 90, the actuator 100 is withdrawn and garter spring 98 urges the bearing housings 92 back into their first position.

As in the prior embodiments, the embodiment of FIGS. 11 and 12 includes a jig 104 to support the container along a bottom peripheral profile portion 106 that substantially corresponds in shape to the outer annular wall 26 of the container 20. As in the prior embodiments, the perimeter 108 of the rollers 90 also include a downwardly tapered configuration which, when placed against the substantially vertical wall 34, reforms that wall 34 to achieve a negative angle relative to the vertical axis of the container 20.

Figure 13:
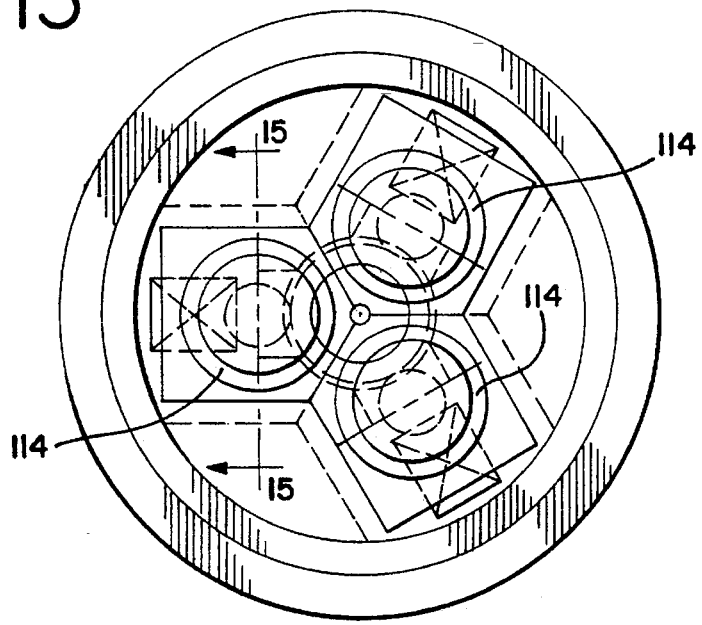
FIG. 13 is a top view of a second non-pivoting embodiment of the apparatus in accordance with the invention.
Figure 14:
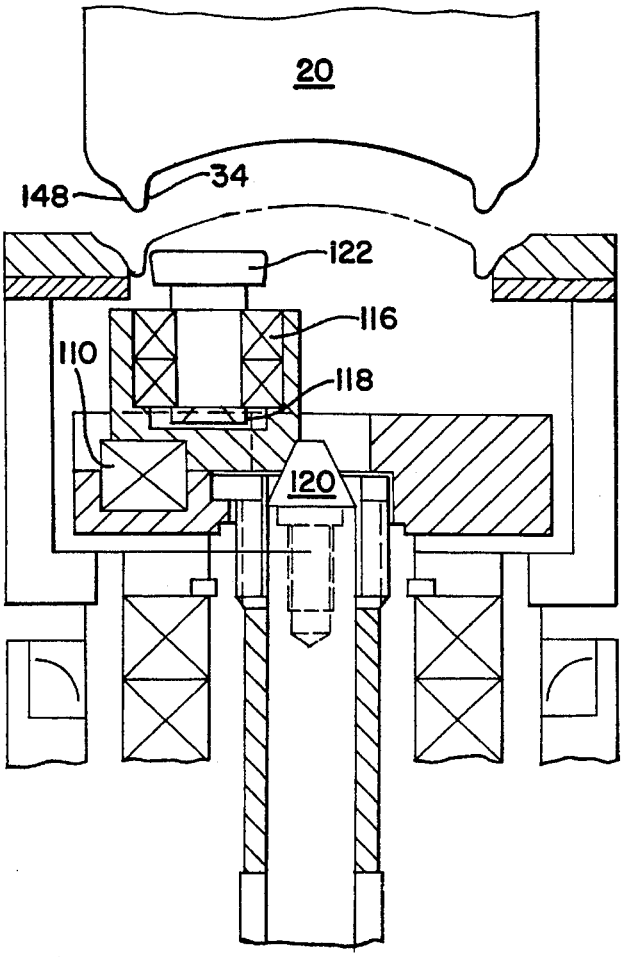
FIG. 14 is a side-sectional view of the apparatus of FIG. 13, and with a container shown in solid lines above the apparatus and in phantom lines in place for processing by the apparatus.
Figure 15:
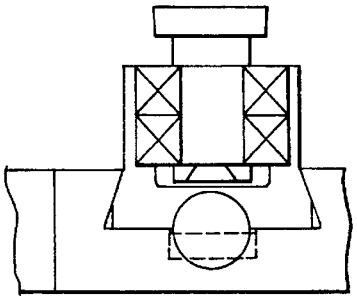
FIG. 15 is a detail of the roller and bearing of FIG. 14, taken along lines 15—15 of FIG. 13.

Another three-roller, non-pivoting embodiment of the apparatus of the invention is shown in FIGS. 13–15. In this embodiment, the spring 110 is horizontally disposed and acts along a horizontal plane. In particular, spring 110 is in contact with the bearing housing 112 to bias that housing 112 in a radially inward direction.

The apparatus of FIG. 13 also includes three rollers 114 secured to bearing housing 112 with a bearing 116 and a bearing clamp 118. These rollers 114 are movable from their first position, as shown in FIGS. 13–15, to a radially outward position where the rollers 114 contact the annular, substantially vertical wall 34 of container 20.

Upward movement of actuator 120 pushes housings 112 radially outwardly until rollers 122 contact the annular, substantially vertical wall 34. Upon completion of treatment of the wall 34 with rollers 122, the actuator 120 is withdrawn and spring 110 urges the bearing housings 112 back into their first position.

Figure 16:
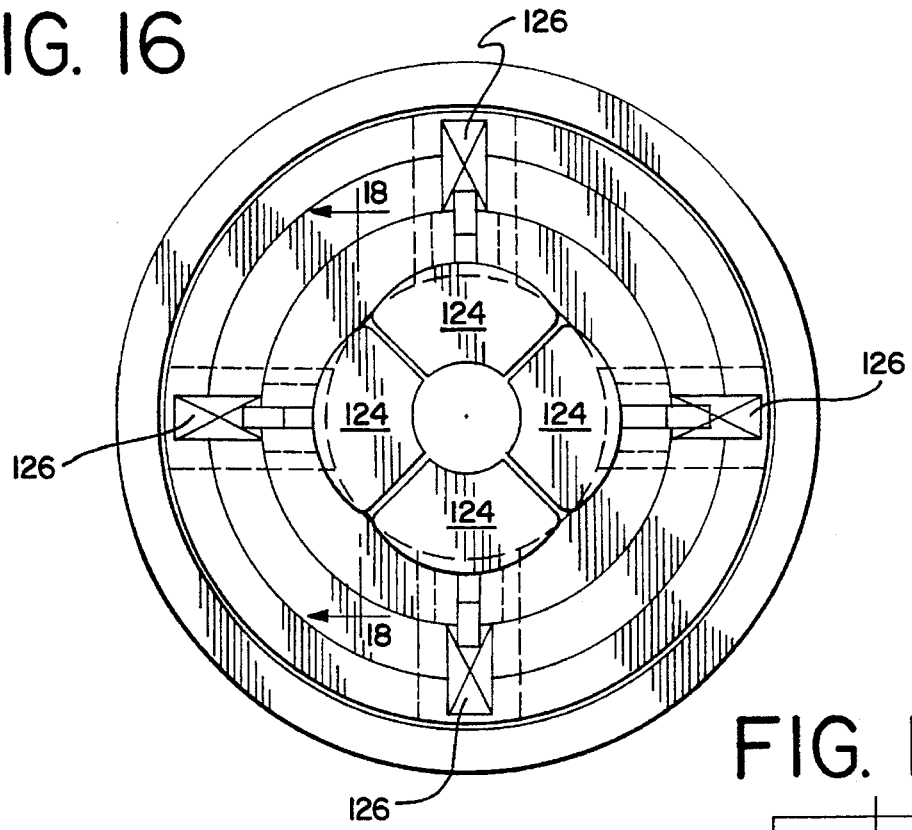
FIG. 16 is a top view of a third non-pivoting embodiment of the apparatus in accordance with the invention.
Figure 18:
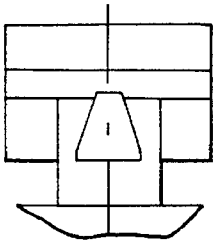
FIG. 18 is a detail of the actuator and dovetail slide portion of a portion of the apparatus of FIG. 16, taken along lines 18—18 of FIG. 16.
Figure 17:
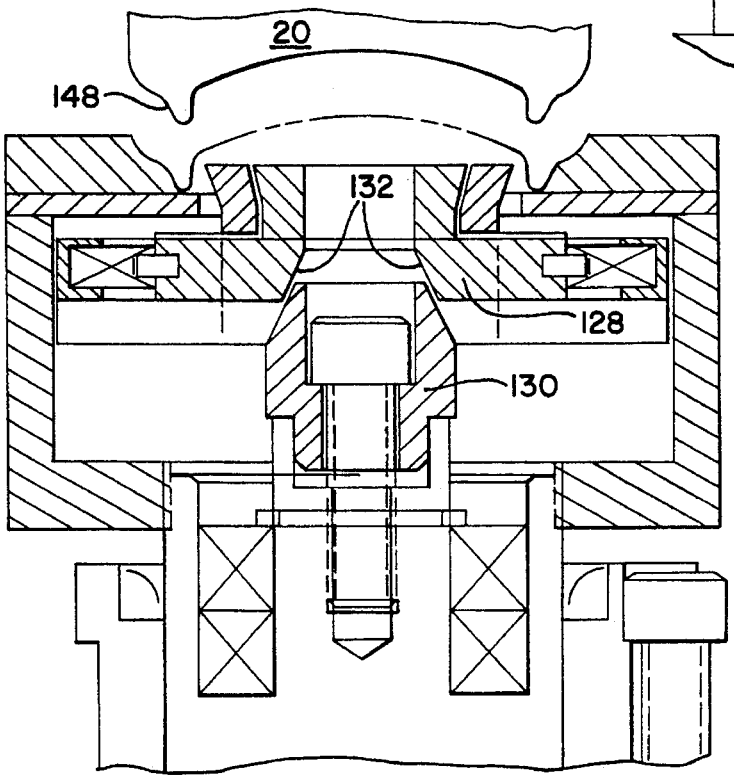
FIG. 17 is a side-sectional view of the apparatus of FIG. 16, and with a container shown in solid lines above the apparatus and in phantom lines in place for processing by the apparatus.

Still another non-pivoting embodiment of the apparatus of the invention is shown in FIGS. 16–18. In this embodiment, however, conventional rollers are not used. Rather, four radially moveable or expandable segments 124 are mounted to the apparatus for radial movement towards and away from the container 20. In the dashed lines of FIG. 16, these segments 124 are shown in their normal, radially inward position. They are held in this position by a plurality of horizontally tensioned springs 126.

Each of these segments 124, which are an alternative type of roller means, may be secured to a housing 128. When an actuator 130 is moved vertically upwardly against camming surfaces 132, housings 128 are pushed radially outwardly, as shown in the solid lines of FIG. 16, until roller segments 124 contact the annular, substantially vertical wall 34. Upon completion of treatment of the wall 34 with roller segments 124, the actuator 130 is withdrawn and springs 126 urge the housings 128 back into their first position.

Figure 19:
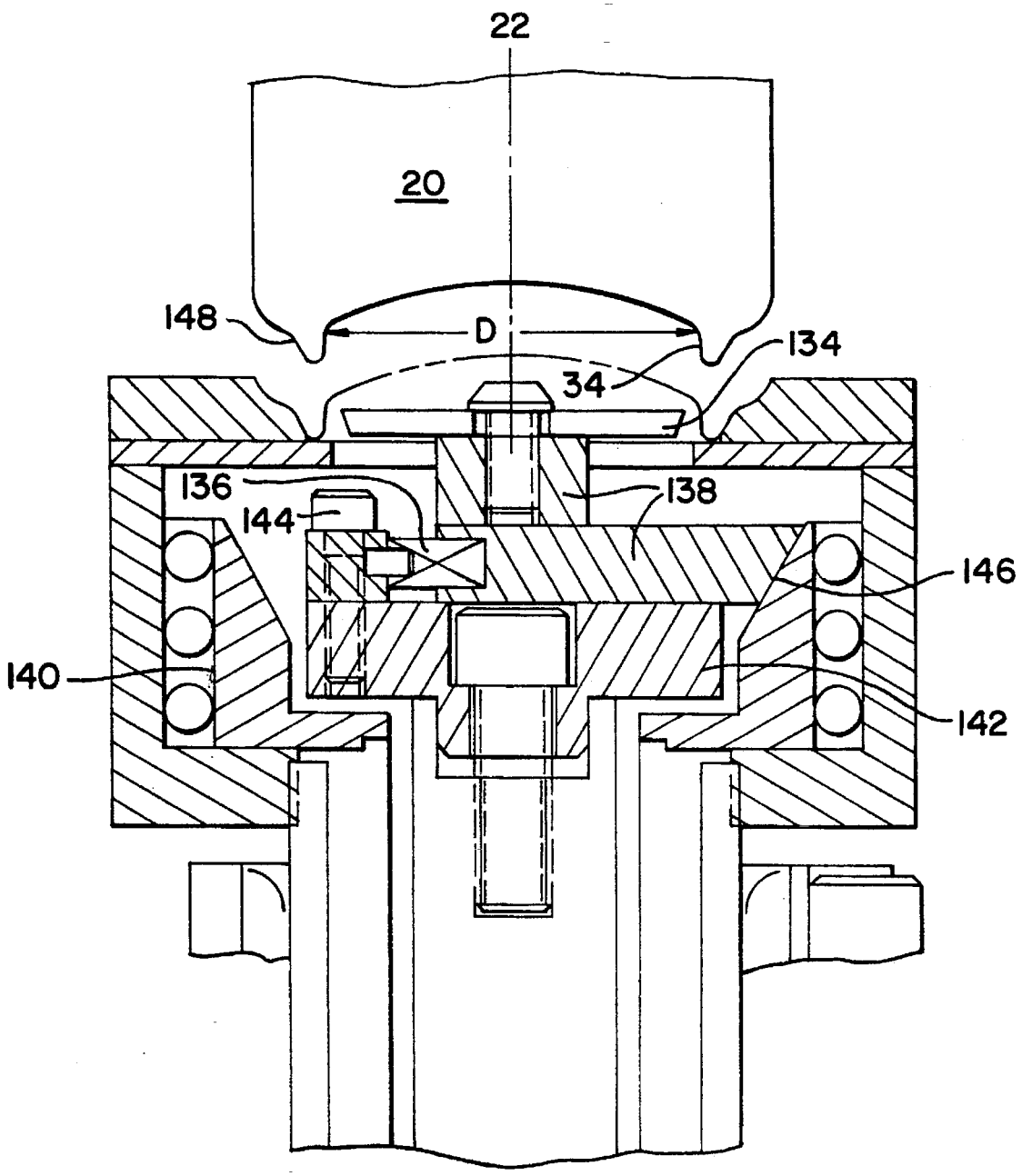
FIG. 19 is a side-sectional view of a fourth non-pivoting apparatus in accordance with the invention, including a single roller, and with a container shown in solid lines above the apparatus and in phantom lines in place for processing by the apparatus.

A final version of a non-pivoting embodiment of the apparatus is shown in FIG. 19. In this embodiment, only one roller is used. This roller 134 has a substantially larger diameter than the rollers of the other embodiments. In fact, the diameter of this roller 134 is in excess of 80 percent of the distance between opposite, facing walls 34. This distance is referred to as "D" in FIG. 19.

Again, this embodiment includes a compression spring 136 which acts along a horizontal plane. Spring 136 is in contact with the housing 138 to bias that housing 138 in a rightward direction. Roller 134 is movable from its first position, as shown in FIG. 19, to a radially outward position where the roller 134 contacts the annular, substantially vertical wall 34.

In the embodiment of FIG. 19, actuator 140 is vertically movable, as in the apparatus of the previously described embodiments. The actuator 140 encircles a dovetailed collar 142, and this collar 142 is fixed. Housing 138, however, is horizontally movable when it is contacted by the upwardly-moving actuator 140. The horizontal movement of the housing 138 is guided by a dovetail groove in collar 142.

Housing 138 abuts against camming surface 146. In addition, with reference to the directions depicted in FIG. 19, spring 136 biases the housing 183 to the right. Thus, housing 138 is moved to the right along the camming surface 146. This rightward movement of the housing 138 continues until the periphery of roller 134 contacts the wall 34 of container 20. Reforming takes place in the same manner as with a three-roller apparatus, but at only one point along the wall 34.

Upon completion of treatment of the wall 34 with roller 134, the actuator 140 is lowered and the weight of the housing/roller combination moves that assembly back onto the collar 142, i.e., to the first position of the device. This collar 142 acts as a limit on the downward movement of the housing 138. In this embodiment and in the others, it is preferred that the actuator 140 rotate at the same speed as housing 138.

A comparison of FIGS. 9 and 10 will disclose the differences in containers before and after bottom reforming in accordance with the method of the present invention. Particularly, FIG. 9 shows a container before bottom reforming. The wall 34 in this figure is substantially vertical and may, in fact, have a slight positive angle. For the left portion of the container shown in FIG. 9, a wall 34 having a slight positive angle would angle upwardly and to the right from vertical line V—V. Referring to FIG. 8 and stated differently, when wall 34 has a positive angle, diameter D1 is greater than diameter D2.

As stated above, the container of FIG. 8 that may be reformed in accordance with this invention is generally symmetrical about a vertical axis 22. The container includes a generally cylindrical side wall 24 parallel with the vertical axis 22. The container 20 also includes an outer annular wall 26, a convex U-shaped portion 28, a preformed bottom wall 30, including a center domed portion 32 and an annular, substantially vertical wall 34 joining the domed portion 32 and the convex U-shaped portion 28.

The method of the present invention may be described with reference to the various apparatuses shown in the figures, including the apparatus of FIGS. 1–3. The method comprises several steps. The container 20 is supported on a jig 48. This jig 48 has a bottom peripheral profile portion 50 substantially corresponding in shape to the outer annular wall 26 of the container 20.

The bottom peripheral profile portion 50 of jig 48 is mated with the outer annular wall 26. Reforming rollers 36 are brought into engagement with the substantially vertical wall 34. The reforming rollers 36 rotate along the vertical wall 34 and about an arcuate path. Through this action, the reforming rollers 36 affect the angle of the substantially vertical wall 34. In particular, the angle of the substantially vertical wall 34 is changed the negative angle from the vertical axis of the container 20.

In this embodiment, the outer wall 148 is held against movement by the bottom peripheral profile portion 50 of jig 48 while the reforming means is brought into contact with the inner, substantially vertical wall 34.

In another embodiment, the outer wall 148 may instead not be held against movement by the bottom peripheral profile portion 50. In this case, the internal forming force of the reforming means may also cause the outer wall 148 to be reformed simultaneously with the reforming of vertical, inner wall 34, i.e., while the reforming means is being brought into contact with the inner wall 34.

As may be seen in FIG. 1A, the reforming rollers 36 of this apparatus are rotated about an arcuate path equidistant from an axis that is coaxial with the axis 22 of the container. Alternatively, as may be appreciated from a review of FIG. 19 and the above description of that figure, the reforming roller 134 of that apparatus may be rotated about an arcuate path that is equidistant from an axis that is not coaxial with the axis 22 of the container 20. This occurs because in order to contact wall 34, the roller 134 is shifted to the right of its position as shown in FIG. 19.

In one aspect of the preferred method, the roller has a peripheral configuration which, upon engagement with the substantially vertical wall, reforms the substantially vertical wall to achieve a negative angle from the vertical axis of the container. Rollers having such peripheral configurations are shown in FIGS. 2, 5, 7, 12, 14, 17 and 19.

In another aspect of the preferred method, an actuator is moved upwardly and towards the can to move a camming surface and its housing in a radially outward direction. In this way, a roller movable with the camming surface engages the substantially vertical wall.

In still another aspect of the preferred method, the roller pivots about a horizontal pivot point. In particular, the apparatus may include a horizontal pivot point about which the roller pivots from an inward non-engaging position to a radially outward position wherein the roller engages the substantially vertical wall.

After this method of bottom reforming, as may be seen in FIG. 10, the wall 34 exhibits a slight negative angle A. The preferred angle A for an ANC-2A can should be no more than approximately –4 degrees from the vertical line V—V. It is believed that enhanced container characteristics could be attained by providing wall 34 with an angle of as much as –8 to –10 degrees. For the left portion of the container shown in FIG. 10, a wall 34 having a slight negative angle would angle upwardly and to the left from vertical line V—V. Referring to FIG. 8 and stated differently, when wall 34 has a negative angle, diameter D1 would be less than diameter D2. The value of the preferred negative angle will vary with each different type of container.

The embodiments above largely discuss rollers or other reforming tools which are moved to contact the inner wall of the container. It should be understood that for purposes of the invention, the phrase "bringing a reforming tool means into pressure engagement with [an] inner, annular bottom wall to reform [the] bottom wall" also includes and contemplates the movement of the container into engagement with the reforming tool. This phrase also contemplates the rotation of the reforming tool against the inner wall, the rotation of the inner wall about the reforming tool, or a combination of both.

Containers treated by the methods or apparatus of the present invention exhibit distinctly superior characteristics when compared with prior art untreated containers. Actual tests were conducted with so-called "ANC-2A" cans, manufactured by American National Can Company. These cans have the general configurations shown in FIGS. 8 and 9, and were made with aluminum having a gauge of 0.120. Prior to treatment of these cans by the method and apparatus of the invention, they exhibited the following characteristics:

TABLE 1

ANC-2A Dome Profile

| | Dome Depth | Dome Growth After 90 PSIG | Buckle Strength | Plate Thickness |
|---|---|---|---|---|
| Minimum | .394 | .052 | 98 | .0120 |
| Maximum | .396 | .060 | 99 | .0120 |
| Average | .396 | .054 | 98 | .0120 |
| Spec/Aim | .394 ± .004 | .064 Max. | 90 Min. | Ref. |

After treatment of these cans by the method and one roller apparatus of the invention, they exhibited the following characteristics:

TABLE 2

ANC Reformed Dome Profile

| | Dome Depth | Dome Growth After 90 PSIG | Buckle Strength | Plate Thickness |
|---|---|---|---|---|
| Minimum | .398 | .005 | 110 | .0120 |
| Maximum | .401 | .006 | 113 | .0120 |
| Average | .400 | .006 | 112 | .0120 |
| Spec/Aim | N/A | .064 Max. | 90 Min. | Ref. |

As can be seen from a comparison of these Tables, buckle strength of treated cans increased from an average of about 99 to an average of 112. The growth in the dome, which results in a downward extension of the U-shaped portion 28 of the container of FIG. 9, decreased markedly from an average of 0.055 to 0.006 inches.

When these same tests were conducted with cans produced from 0.110 gauge aluminum, buckle strength increased from an average of 90 to an average of 98. Dome growth tests after 90 PSIG were not meaningful, as the non-reformed cans failed and buckled at 90 PSIG or less.

Figure 20:
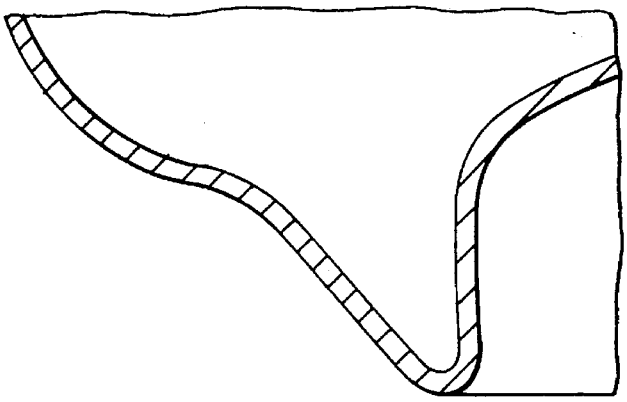
FIG. 20 is a photographic profile of a cross-section of a lower portion of a can reformed by a prior art process.

A number of standard ANC-2A cans were reformed. In the first set, the outside of the countersink was reformed in accordance with a CMB method and its results are shown in Table 3. A photographic profile of a lower portion of one of these cans is shown in FIG. 20.

TABLE 3

Body Strength
206/211 × 413 CMB Reformed Dome Cans

| | Dome Depth | Dome Growth After 90 PSIG | Buckle Strength | Plate Thickness |
|---|---|---|---|---|
| Minimum | .385 | .008 | 104 | .0120 |
| Maximum | .395 | .012 | 109 | .0120 |
| Average | .392 | .010 | 106 | .0120 |
| Spec/Aim | N/A | .064 Max. | 90 Min. | Ref. |

| | Vertical Crush | Sidewall Thickness |
|---|---|---|
| Minimum | 266 | .0045 |
| Maximum | 292 | .0046 |
| Average | 279* | .0046 |
| Spec/Aim | 250 Min. | |

Figure 21:
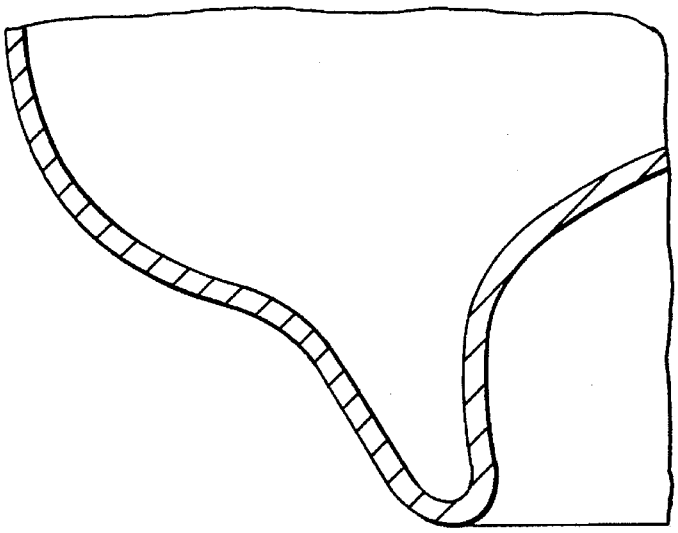
FIG. 21 is a photographic profile of a cross-section of a lower portion of a can reformed by the process of the present invention.

The second set of cans was reformed on the inside of the countersink in accordance with the present invention and its results are shown in Table 4. A photographic profile of a lower portion of one of these cans is shown in FIG. 21.

TABLE 4

Body Strength
206/211 × 413 ANC Reformed Dome Cans

| | Dome Depth | Dome Growth After 90 PSIG | Buckle Strength | Plate Thickness |
|---|---|---|---|---|
| Minimum | .397 | .003 | 104 | .0120 |
| Maximum | .410 | .007 | 114 | .0120 |
| Average | .404 | .004 | 110 | .0120 |
| Spec/Aim | N/A | .064 Max. | 90 Min. | Ref. |

| | Vertical Crush | Sidewall Thickness |
|---|---|---|
| Minimum | 305 | .0045 |
| Maximum | 321 | .0047 |
| Average | 313* | .0046 |
| Spec/Aim | 250 Min. | |

Figure 22:
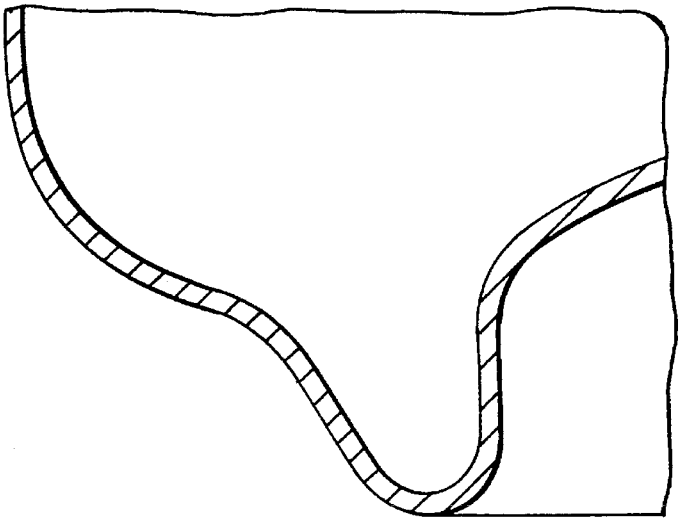
FIG. 22 is a photographic profile of a cross-section of a lower portion of a "control" can prior to reforming.

Table 5 shows results from "control" cans, i.e., standard ANC-2A cans prior to reforming of any kind. A photographic profile of a lower portion of one of these cans is shown in FIG. 22.

TABLE 5

Body Strength
206/211 × 413 ANC-2A Control Cans

| | Dome Depth | Dome Growth After 90 PSIG | Buckle Strength | Plate Thickness |
|---|---|---|---|---|
| Minimum | .396 | .042 | 98 | .0120 |
| Maximum | .398 | .059 | 99 | .0120 |

TABLE 5-continued

| Body Strength 206/211 × 413 ANC-2A Control Cans | | | | |
|---|---|---|---|---|
| Average | .397 | .048 | 99 | .0120 |
| Spec/Aim | .394 ± .004 | .064 Max. | 90 Min. | Ref. |

| | Vertical Crush | Sidewall Thickness |
|---|---|---|
| Minimum | 310 | .0045 |
| Maximum | 322 | .0046 |
| Average | 317* | .0046 |
| Spec/Aim | 250 Min. | |

As may be seen by a comparison of these Tables, dome growth in the untreated can of Table 5 averages 0.050 inches. Both reformed cans show improvement, but the average dome growth of the can reformed in accordance with the present invention is significantly superior (0.005 vs. 0.010 inches). Buckle strength is also somewhat improved (109 vs. 106). Finally, while average vertical crush of the present reformed cans (313) remains virtually the same as the control can (317), average vertical crush drops significantly (279) after reforming by the CMB method.

As may be seen by a comparison of FIGS. 20 and 21, the can that has been reformed in accordance with the present invention is less sharply peaked along its bottom. As a result, this can will exhibit more stability when moving along fill lines.

Figure 23:
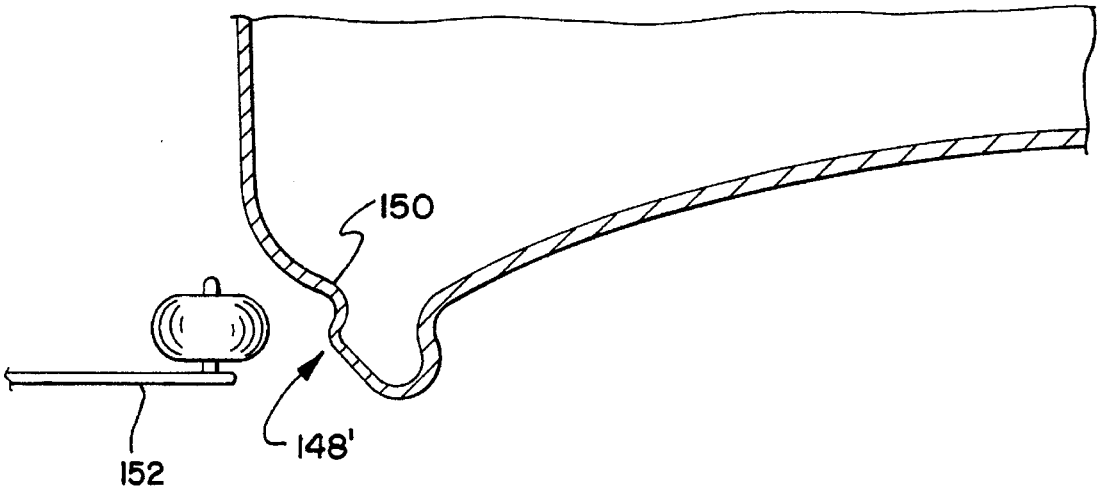
FIG. 23 is an enlarged cross-sectional view of an alternative embodiment of a bottom profile of a container with improved resistance of internal pressure.

An alternative embodiment of the bottom profile is disclosed in FIG. 23. In this embodiment, additional strength is achieved by reforming the outer wall 148'. Part of the buckle phenomenon is that when the countersink wall inverts, a countersink diameter change takes place. Thus, a spun in annular recess 150 on the outer wall 148' will increase the container's 20 resistance to pressure. The annular recess 150 may be formed continuously around the outer wall 148' or as a plurality of segments spaced circumferentially around the outer wall 148'. The annular recess 150 is preferably formed by pressure engagement of the outer wall 148' with a forming tool 152. The annular recess preferably has an arcuate cross-sectional shape.

As shown in FIG. 23, a lower portion of the annular recess 150 formed by the forming tool 152, slopes upwardly toward the top of the container and inwardly toward the central or longitudinal axis of the container. The lower portion of the annular recess 150 is connected at its uppermost point to an upper portion of the annular recess 150 by an outwardly concave radius. The upper portion of the annular recess 150 slopes upwardly toward the top of the container and outwardly away from the central axis of the container. The lower portion of the annular recess is connected at its lowermost point to a portion of the outer annular wall 148' which extends from the base of the container upwardly toward the top of the top of the container and outwardly away from the interior of the container.

While the specific embodiments have been demonstrated and described, numerous modifications come to mind without markedly departing from the spirit of the invention. The scope of protection is, thus, only intended to be limited by the scope of the accompanying claims.

What we claim is:

1. A method of reforming the bottom of a drawn and ironed container, said container having a longitudinal axis; a generally cylindrical side wall parallel with said longitudinal axis; a convex U-shaped portion; a concave outer annular wall jointing said side wall to said convex U-shaped portion; a preformed bottom wall, including a center portion; and an annular inner wall joining said convex U-shaped portion; said method comprising:

bringing a reforming roller into engagement with said concave outer annular wall wherein said reforming roller effects a recess having a portion which slopes upwardly toward a top of said container and inwardly toward said longitudinal axis of said container on at least a portion of said concave outer annular wall.

2. The method of claim 1 wherein said reforming roller effects said recess continuously around said outer annular wall.

3. The method of claim 2 wherein said recess has an arcuate cross-sectional shape.

4. The method of claim 1 wherein said reforming roller effects a plurality of recess segments spaced around said outer annular wall.

5. The method of claim 4 wherein said recess segments have an arcuate cross-sectional shape.

6. A container comprising a longitudinal axis; a generally cylindrical side wall parallel with said longitudinal axis; a convex U-shaped portion; a concave outer annular wall joining said side wall to said convex U-shaped portion; a preformed bottom wall, including a center portion; and an annular inner wall joining said center portion to said convex U-shaped portion; said concave outer annular wall having an annular recess including a portion which slopes upwardly toward a top of said container and inwardly toward said longitudinal axis of said container.

7. The container of claim 6 wherein said annular recess has an arcuate cross-sectional shape.

8. A container comprising a longitudinal axis; a generally cylindrical side wall parallel with said longitudinal axis; a convex U-shaped portion; a concave outer annular wall joining said side wall to said convex U-shaped portion; a preformed bottom wall, including a center portion; and an annular inner wall joining said center portion to said convex U-shaped portion; said concave outer annular wall having plurality of recessed segments spaced around said concave outer annular wall wherein said recessed segments include a portion which slopes upwardly toward a top of said container and inwardly toward said longitudinal axis of said container.

9. The container of claim 8 wherein said recessed segments have an arcuate cross-sectional shape.

10. A container comprising a longitudinal axis; a generally cylindrical side wall parallel with said longitudinal axis; a convex U-shaped portion; a concave outer annular wall joining said side wall to said convex U-shaped portion; a preformed bottom wall, including a center portion; and an annular inner wall joining said center portion to said convex U-shaped portion wherein said inner wall is at a negative angle with respect to a central axis of said container; and said concave outer annular wall having an annular recess, said annular recess having a portion which slopes upwardly toward a top of said container and inwardly toward said longitudinal axis.

11. A method of reforming the bottom of a container, said container having a longitudinal axis; a generally cylindrical side wall parallel with said longitudinal axis; a convex U-shaped portion; a concave outer annular wall joining said side wall to said convex U-shaped portion; a preformed bottom wall including a center portion; and an annular, substantially longitudinal wall joining said center portion and said convex U-shaped portion, said method comprising:

supporting said container in a jig, said jig having a bottom peripheral profile portion substantially corresponding in shape to said outer annular wall of said container;

mating the bottom peripheral profile portion of said jig with said concave outer annular wall;

bringing a first reforming roller into engagement with said substantially longitudinal wall, said reforming roller rotating along said longitudinal wall and about an arcuate path in substantially radial alignment with said mating of said jig and said concave outer annular wall;

wherein said reforming roller effects the angle of said substantially longitudinal wall; and in a further operation bringing a second reforming roller into engagement with said concave outer annular wall, wherein said second reforming roller effects an annular recess having a portion which slopes upwardly toward a top of said container and inwardly toward said longitudinal axis of said container along said concave outer annular wall.

* * * * *